US006619887B1

(12) United States Patent
Szewczyk et al.

(10) Patent No.: US 6,619,887 B1
(45) Date of Patent: Sep. 16, 2003

(54) METHOD AND APPARATUS FOR REDUCING DRAG AND SUPPRESSING VORTEX-INDUCED VIBRATION

(76) Inventors: Albin A. Szewczyk, 17731 Willowbrook Dr., South Bend, IN (US) 46635; John C. Owen, The Rectory, Clifton Upon Teme, Worcester (GB), WR6 6DJ; Peter W. Bearman, 10 West Park Road, Kew Surry (GB), TW9 4DA ( * ) Notice: Subject to any disclaimer, the term of this patent is extended or adjusted under 35 U.S.C. 154(b) by 0 days.

(21) Appl. No.: 09/990,029

(22) Filed: Nov. 21, 2001

Related U.S. Application Data

(60) Provisional application No. 60/252,678, filed on Nov. 21, 2000.

(51) Int. Cl.[7] ..... E02D 5/60
(52) U.S. Cl. ..... 405/211; 405/224
(58) Field of Search ..... 405/211, 216, 405/211.1, 224, 224.2; 114/243; 166/367

(56) References Cited

U.S. PATENT DOCUMENTS 4,265,567 A * 5/1981 Nybo ..... 166/367
5,553,976 A * 9/1996 Korsgaard ..... 138/113

OTHER PUBLICATIONS

John C. Owen, Peter W. Bearman and Albin A. Szewczyk; article entitled "*Passive Control of VIV with Drag Reduction,*" Journal of Fluids and Structures (2001) 15, pp. 597–605.

John C. Owen, Albin A. Szewczyk and Peter W. Bearman, abstract entitled "*Suppressing Karman Vortex Shedding by Use of Sinuous Circular Cylinders*" Bulletin of the American Physical Society (vol. 44, No. 8 (1999); p. 124).

John C. Owen, Albin A. Szewczyk and Peter W. Bearman; article entitled "*Suppression of Karman Vortex Shedding*".

Peter W. Bearman and John C. Owen; article entitled "*Reduction of Bluff–Body Drag and Suppression of Vortex Shedding by the Introduction of Wavy Separation Lines*" Journal of Fluids and Structures (1998), 12, pp. 123–130.

John Clifford Owen, thesis entitled "*Passive Control of Vortex Shedding in the Wakes of Bluff Bodies*" Ph.D. dissertation, University of London, London, U.K., 2001.

Hiroyuki Honji and Kohji Ishi–I; article entitled "*Wake Shedding from a Distorted Cylinder*" J. Phys. Soc. Japan, Letters, 41, No. 3 Sep. 1976; pp. 1089, 1090.

* cited by examiner

*Primary Examiner*—Heather Shackelford
*Assistant Examiner*—Lisa Saldano
(74) *Attorney, Agent, or Firm*—Barnes & Thornburg

(57) ABSTRACT

A structural element comprises an elongate body having a longitudinal axis extending along the wavy path. The body is coupled to a support on at least one end. At least a portion of the body extends through an area of fluid flow such that a plane containing the wavy path lies substantially parallel to the direction of flow. In one embodiment, the longitudinal axis extends along a substantially sinusoidal path. Also disclosed is a method of reducing drag on and suppressing vortex induced vibrations in an elongate body disposed in an area of directional fluid flow, comprising the steps of coupling at least one end of the body to a support, forming a longitudinal axis of the body along a wavy path, and orienting the body such that the wavy longitudinal path lies in a plane substantially parallel to the direction of fluid flow.

14 Claims, 12 Drawing Sheets

METHOD AND APPARATUS FOR REDUCING DRAG AND SUPPRESSING VORTEX-INDUCED VIBRATION

RELATED APPLICATION

This application is based upon United States Provisional Application Ser. No. 60/252,678, filed on Nov. 21, 2000, the complete disclosure of which is hereby expressly incorporated herein by this reference thereto.

FIELD OF INVENTION

This invention relates generally to fluid flow around elongated bluff bodies. More particularly, this invention relates to methods and structures for reducing drag and the effects associated with drag, and suppressing vortex-induced vibrations caused by vortex shedding associated with elongate bluff bodies disposed in fluid flow streams.

BACKGROUND

When a bluff body (i.e., a body having a broad flattened or rounded front), such as a piling, chimney, off shore riser, support tower, or similar structure is placed in a fluid flow stream, a drag force is created by the flow and exerted on the body. Additionally, vortex shedding can occur which induces forces that can lead to undesirable vibrations. Such vortex-induced vibrations can, if unabated, lead to premature structural deterioration or failure. The costs associated with constructing or strengthening structures to effectively resist drag forces, and to abate or compensate for the effects of vortex-induced vibrations, can be significant.

It is known to attach fairings or other structures to elongated bodies to modify fluid flow around such bodies to reduce drag and vortex shedding. The use of staggered separation wires, helical strakes, collars, rings, and fibers attached to the periphery of the body have been known to effectively disrupt regular vortex shedding. However, such measures often increase drag which is disadvantageous.

Discussions of vortex shedding may be found in E. Naudascher, D. Rockwell "FLOW-INDUCED VIBRATIONS an Engineering Guide," IAHR-AIRH, Hydraulic structures design manual, A. A. Balkema/Rotterdam/Brookfield/1994, 160–176 and M. M. Zdravkovich, "Review and Classification of Various Aerodynamic and Hydrodynamic Means for Suppressing Vortex Shedding," Journal of Wind Engineering and Industrial Aerodynamics, 7 (1981) 145–189.

A description of a unidirectional fairing for use on a drilling riser to reduce vortex-induced vibration is described in U.S. Pat. No. 6,048,136.

Another area where fluid flow around bluff bodies is encountered is in modern heat exchanger technology. Efficient and reliable operation of heat exchangers is determined in part by flow induced vibration of their fundamental elements. A common group of elements in such heat exchangers are bluff bodies that encounter a cross flow of air or other fluid. Such bodies may be circular cylinders (tubes), rectangular or elliptical pipes, and bodies of other geometric shapes. A circular cylinder is perhaps the most commonly used geometrical shape for elements in heat exchangers, power generators and other thermal apparatus. The circular cylinder is also a shape commonly used in boilers, steam and gas turbines, gas compressors and various other aerodynamic and hydrodynamic systems.

Circular cylinders, or tubes of similar cross-sectional shapes, are also used as structural elements in buildings, as pipe lines and, as previously mentioned, pilings, chimneys, off shore risers, and support towers.

There is a need for improved cross flow heat exchanger performance which may be achieved by reducing drag and suppressing vortex-induced vibrations in heat exchanger elements. There also exists a need to reduce drag and suppress vortex-induced vibrations in structural elements in many other of the applications cited above.

SUMMARY OF THE INVENTION

One aspect of the present invention provides a structural element which comprises an elongate body having a longitudinal axis extending along a wavy path. The body is coupled to a support on at least one end, and at least a portion of the body extends through an area of substantially unidirectional fluid flow. The body is oriented relative to the fluid flow such that a plane containing the wavy axis lies substantially parallel to the direction of fluid flow.

In one embodiment, the longitudinal axis extends along a substantially sinusoidal path. In other embodiments, the elongate body is coupled to a support at both ends. The portion of the body extending through the area of fluid flow preferably extends for multiple wave lengths through the flow area, and the wave steepness of the longitudinal axis is 0.05 or greater.

Another aspect of the invention comprises a method of reducing drag on and suppressing vortex-induced vibrations in an elongate body disposed in an area of directional fluid flow. The subject method comprises the steps of coupling at least one end of the body to a support, forming a longitudinal axis of the body along a substantially wavy path, and positioning the elongate body in the area of fluid flow such that a plane containing the wavy axis lies substantially parallel to the direction of fluid flow.

In certain embodiments, the elongate body has a substantially circular cross section. In this and other embodiments of the subject method, the longitudinal axis may extend along a substantially sinusoidal path. The subject method may include additional steps of connecting a second end of the body to a structure, device or apparatus to be supported by the elongate body, or coupling both ends of the body between respective supports.

Other advantages and novel features of the present invention will become apparent from the following detailed description of the invention when considered in conjunction with the accompanying drawings.

BRIEF DESCRIPTION OF THE FIGURES

Embodiments of the invention are described below with reference to the accompanying drawings in which.

DETAILED DESCRIPTION OF THE FIGURES

Figure 1:
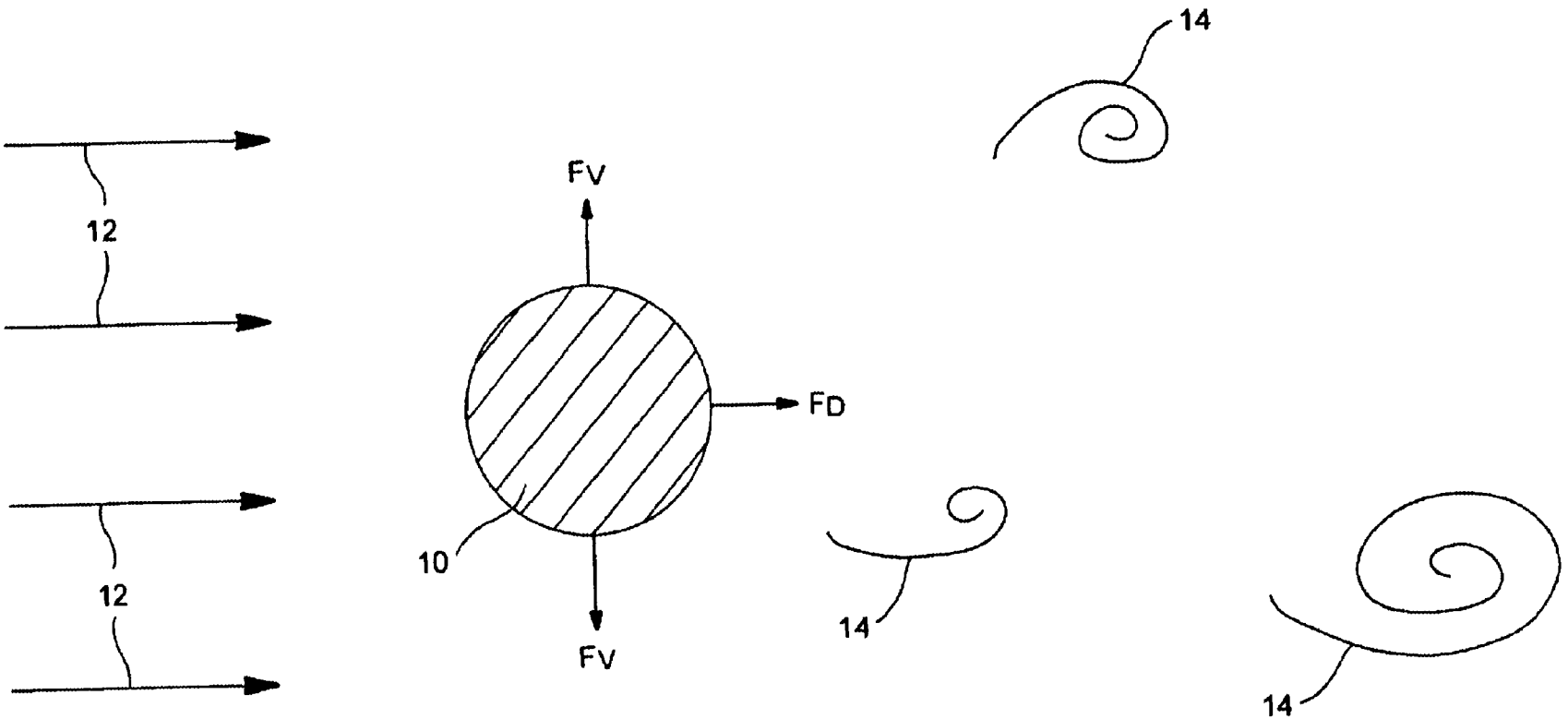
FIG. 1 schematically illustrates forces acting upon an elongate body having a substantially circular cross section disposed in an area of directional fluid flow.

FIG. 1 schematically illustrates forces acting upon an elongate body 10 having a substantially circular cross section disposed in an area of fluid flow. The direction of fluid flow is generally illustrated by arrows 12. Fluid flow 12 creates a drag force $F_d$ acting upon body 10, as illustrated, in the direction of the fluid flow. Vortices 14 are shed from alternating sides of body 10 and move downstream within fluid flow 12. As vortices 14 are shed, they subject body 10 to varying vortex shedding forces, $F_d$, that are generally periodic in nature. The vortex shedding forces $F_d$ can vary in magnitude, direction and timing. The presence of forces $F_d$ raises the possibility of vortex-induced vibrations within body 10 which are generally undesirable and potentially harmful and destructive. The presence of a high drag force $F_d$ increases the required structural strength of body 10.

Figure 2:
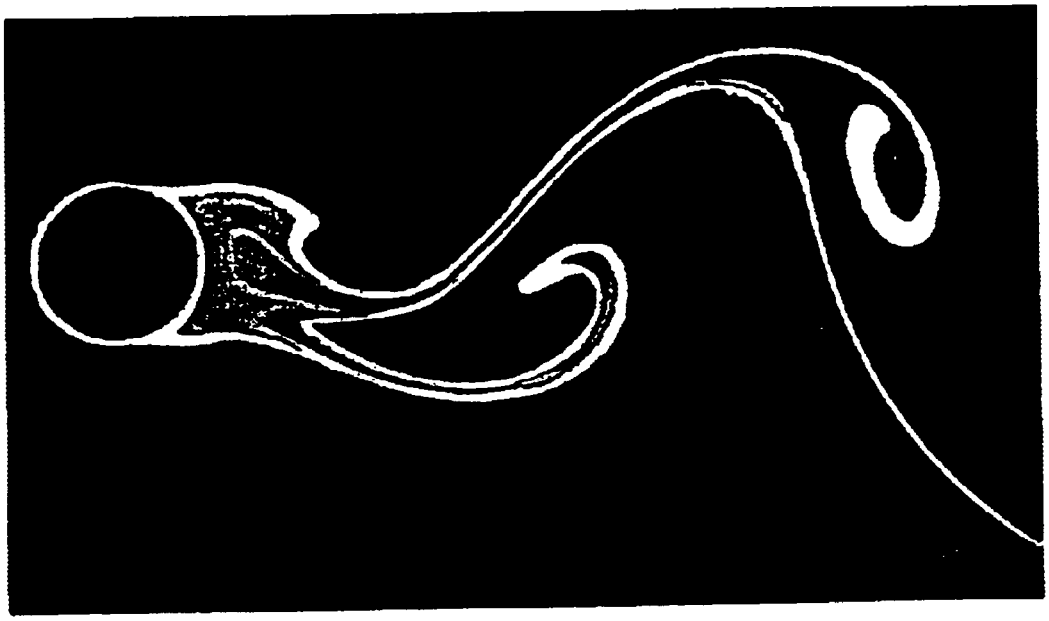
FIG. 2 shows a visualization of regular Karman vortex shedding associated with an elongate body having a substantially circular cross section disposed in an area of directional fluid flow.

FIG. 2 shows a visualization of regular Karman vortex shedding in fluid flow past an elongate body having a substantially circular cross section and a substantially straight (i.e., non-wavy) axis. The presence of the vortices in the top right side and center of FIG. 2 result in shedding forces on the elongate body. These forces induce vibrations within the body, as described above.

Figure 3:
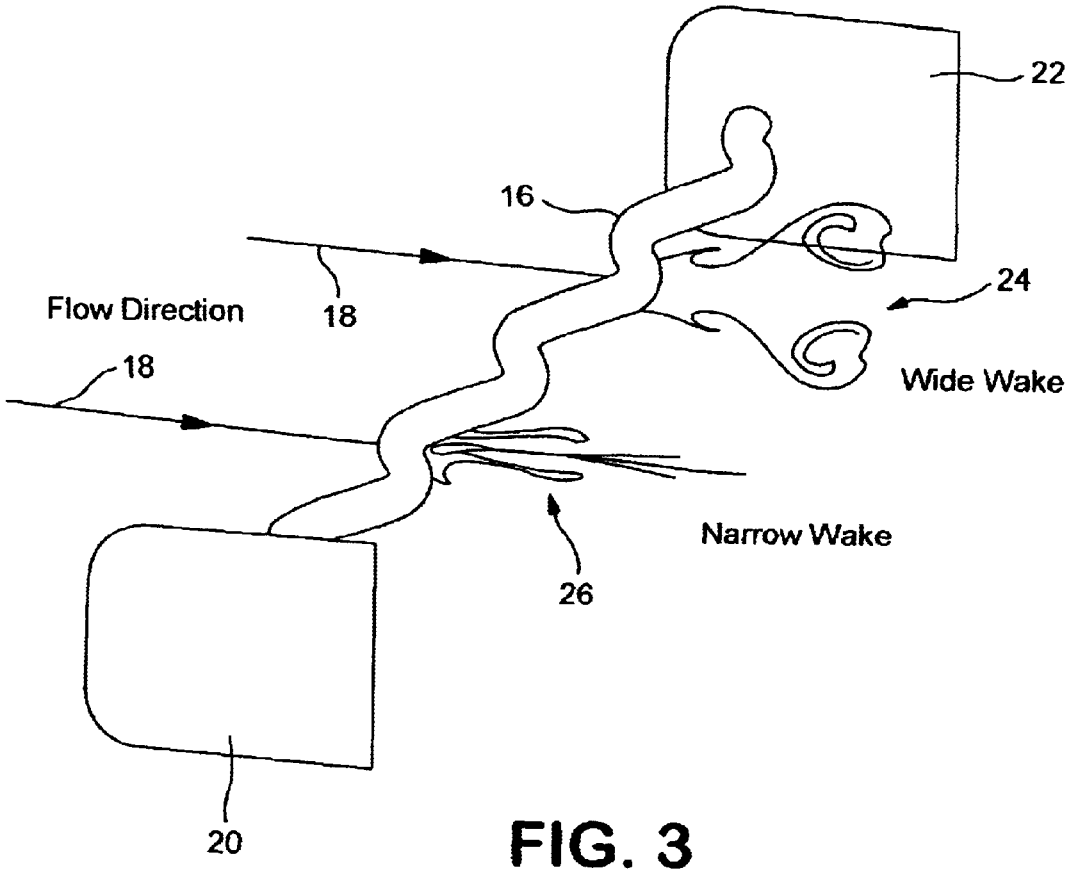
FIG. 3 illustrates an arrangement wherein an elongate body having a substantially circular cross section and a substantially sinusoidal or wavy elongate axis is disposed in an area of directional fluid flow, with the plane of the wavy axis oriented parallel to the direction of the flow.

FIG. 3 illustrates an experimental arrangement in which an elongate body 16 having a substantially circular cross section is disposed in a fluid flow having a direction illustrated by arrows 18. Body 16 has a longitudinal axis which extends along a substantially sinusoidal or wavy path in a direction which is generally normal to flow direction 18. The ends of body 16 are coupled to supports 20 and 22. Body 16 is oriented so that a plane which contains the wavy longitudinal axis is substantially parallel to flow direction 18.

Figure 4:
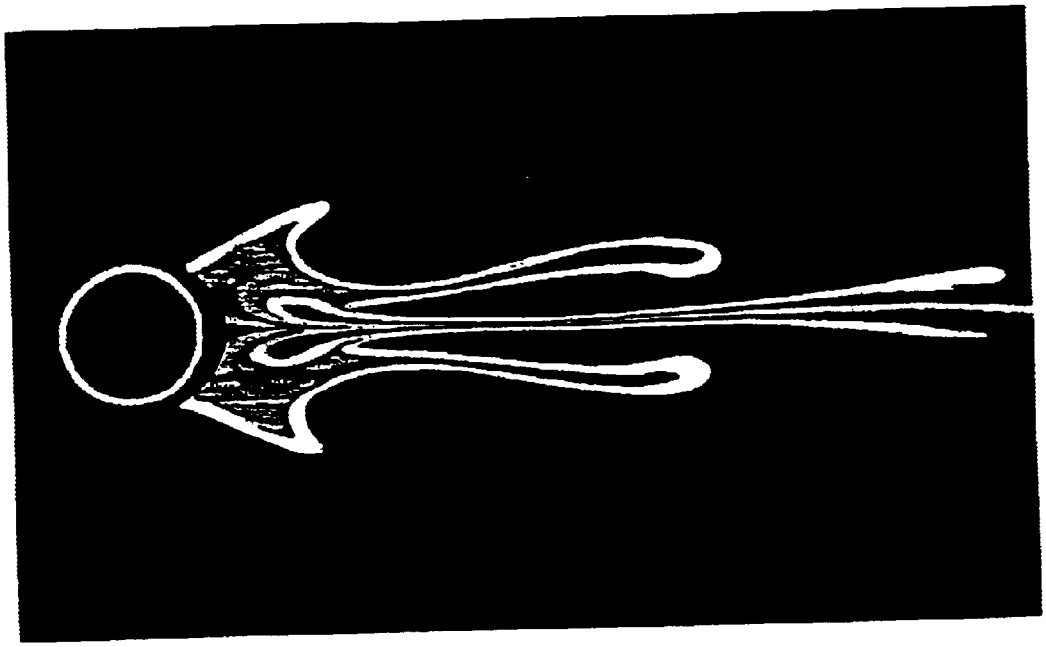
FIG. 4 shows a visualization of a narrow wake observed in tests involving the elongate body of FIG. 3.
Figure 5:
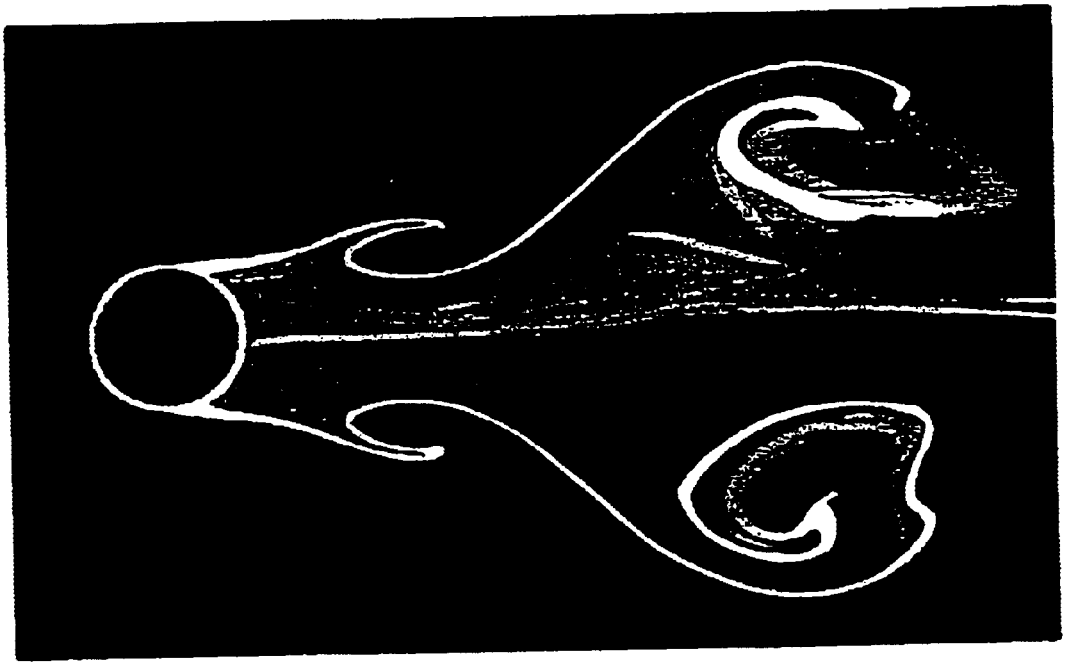
FIG. 5 shows a visualization of a wide wake observed in tests involving the elongate body of FIG. 3.

As illustrated in FIG. 3, a relatively wide wake 24 is created in the vicinity of the "troughs" (the portions of the wavy cylinder which are farthest downstream), while a relatively narrow wake 26 is created in the vicinity of the "peaks" (the portions of the wavy cylinder farthest upstream). FIG. 4 shows a visualization of narrow wake 26 observed in the vicinity of the peaks of wavy elongate body 16. FIG. 5 shows a visualization of wide wake 24 observed in the vicinity of the troughs of body 16. The visualizations of FIGS. 4 and 5 were made under flow conditions substantially similar to those associated with the flow visualization of FIG. 2. The symmetrical nature of wakes 24 and 26, and particularly the absence of the alternating vortices apparent in FIG. 2, illustrate the suppression of regular Karman vortex shedding which is observed in a configuration such as that shown in FIG. 3. Approximately five wave lengths are present in the arrangement of FIG. 3. The ratio of wave length to diameter is approximately 7.5. The wave steepness (as defined below) is approximately 0.1667. The aspect ratio is 37.5.

In testing the wavy cylindrical body 16 of FIG. 3, an overall reduction of drag of up to 47% was observed. The narrow wakes are associated with less drag than the wide wakes. However, the recurrent narrow wake/wide wake combination is believed to result in an overall reduction of drag, as was observed. The recurrent wavyness sets up the base pressure which in turn sets up the span wise distribution of vorticity. The span wise component of the vorticity appears first at the inflection point and moves toward the trough, or area of wide wake. It is believed to be the 3-dimensional flow set up by the recurrent structure that provides for the overall reduction of drag and the suppression of Karman vortex shedding.

Figure 6:
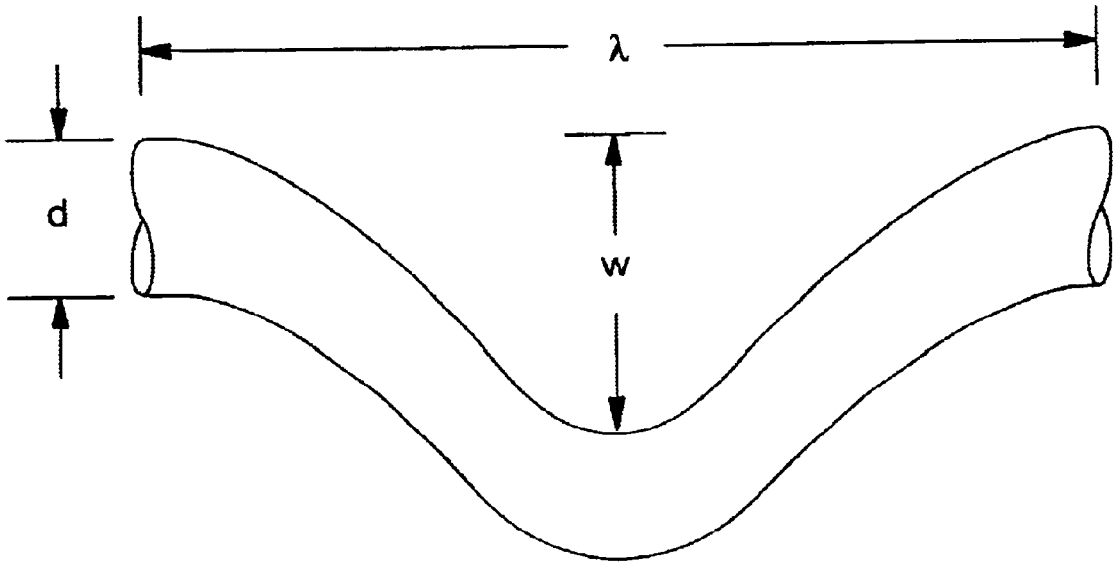
FIG. 6 illustrates the manner in which wave steepness is defined in the present context.

FIG. 6 illustrates a portion of body 16 showing the dimensions d(diameter), $\lambda$(wave length), and w(wave height). For purposes of the present discussion, wave steepness is defined as $w/\lambda$.

Figure 7:
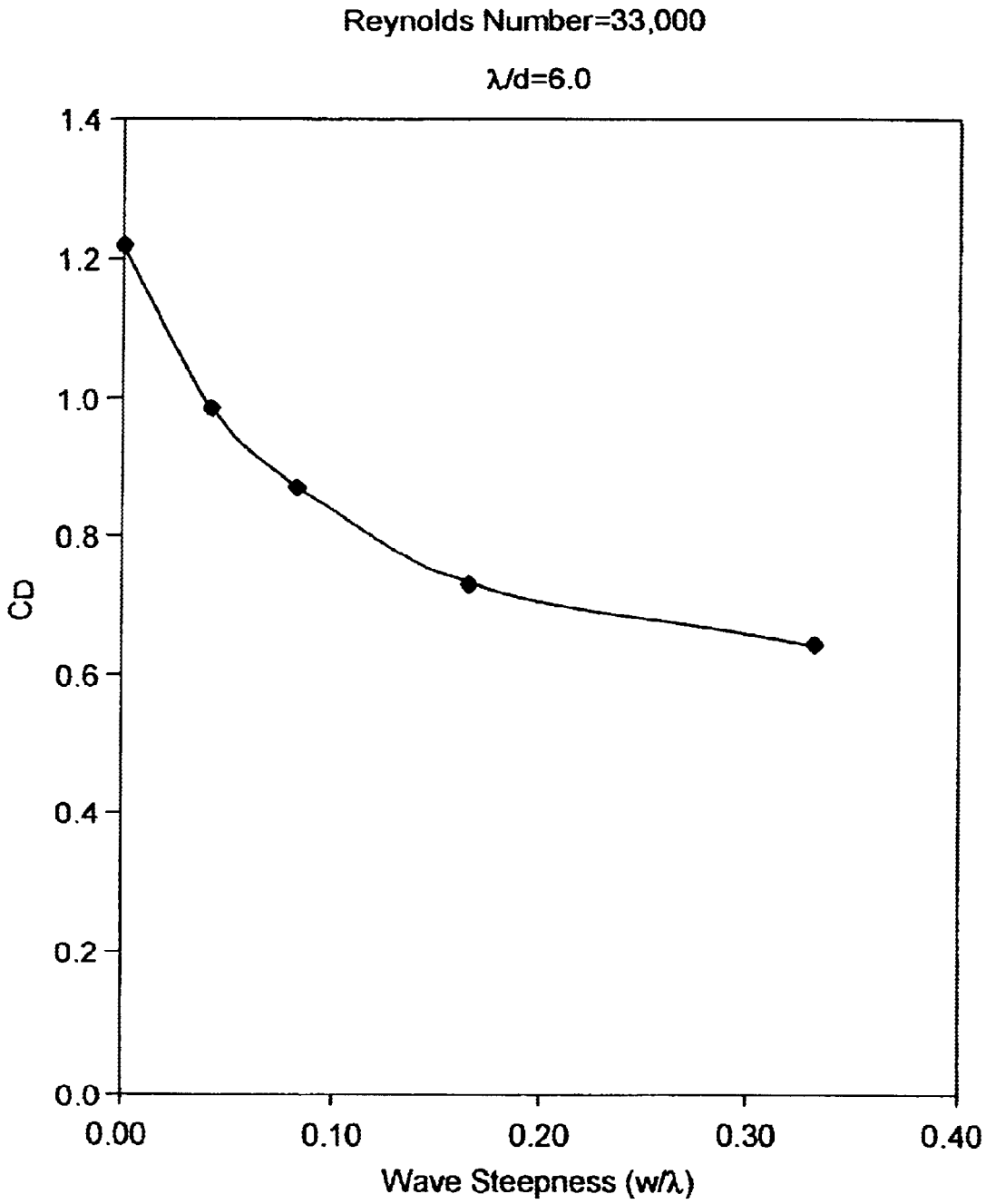
FIG. 7 is a graph which illustrates the effect of wave steepness on the drag coefficient associated with an elongate body of the type shown in FIG. 3.

FIG. 7 is a graph which illustrates the reduction in drag coefficiency $C_d$ observed in tests in which a wavy elongate cylinder having different wave steepnesses was disposed in a flow having a Reynolds number of 33,000. As illustrated, the drag coefficient decreases substantially as the wave steepness increases.

Figure 8:
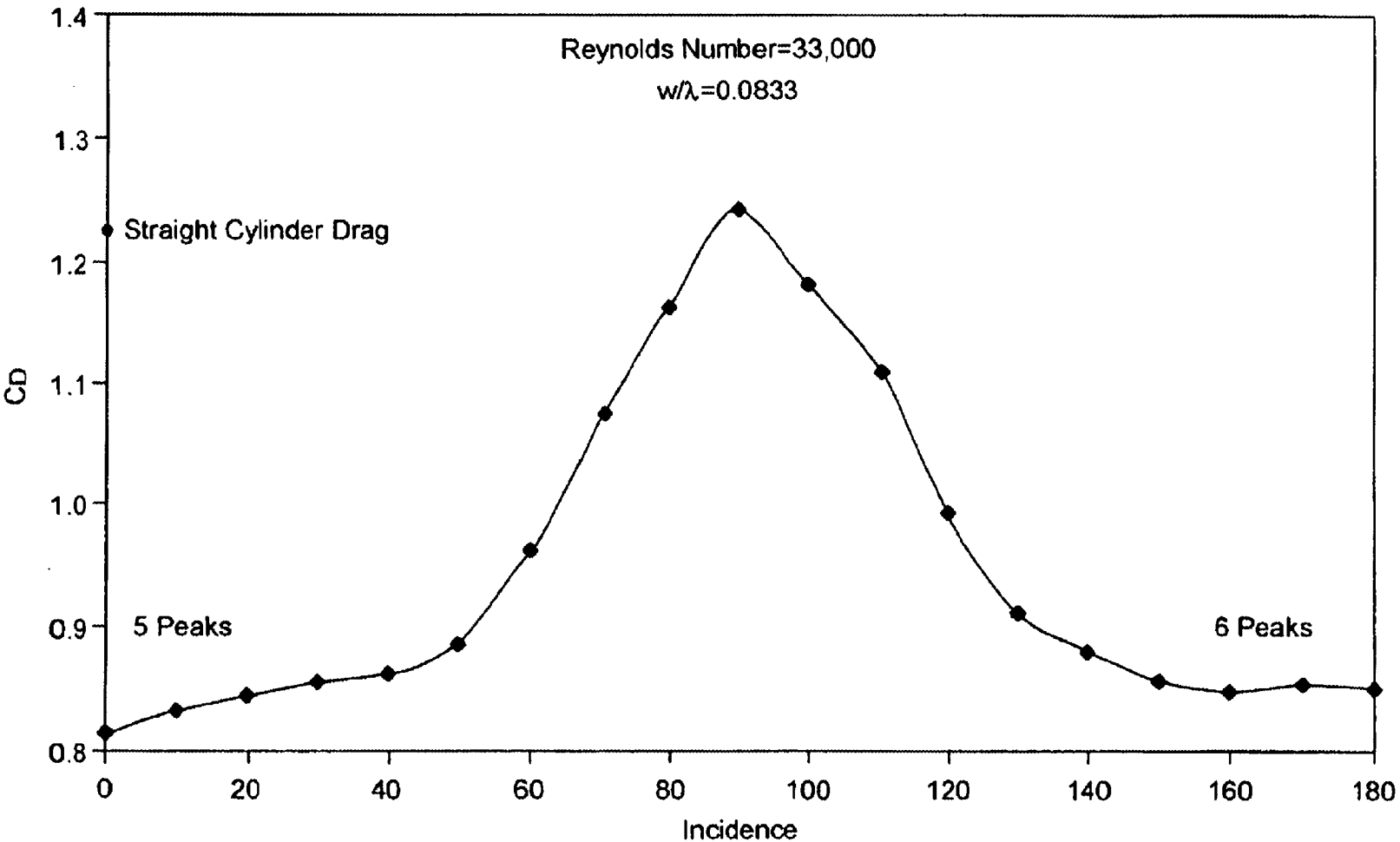
FIG. 8 is a graph which illustrates the effect of flow incidence on the drag coefficient associated with an elongate body of the type shown in FIG. 3.

FIG. 8 shows a graph which illustrates the effect of the angle of incidence of fluid flow on drag coefficient. As indicated, when a plane containing the wavy axis is oriented in the direction of flow (i.e., approximately 0° and 180°), the drag coefficient is substantially reduced. As angle of incidence approaches 90°, drag coefficient increases. At 90°, the drag coefficient for a wavy cylinder having a wave steepness of 0.0833 is slightly higher than the coefficient observed for a straight (non-wavy) cylinder.

Figure 9:
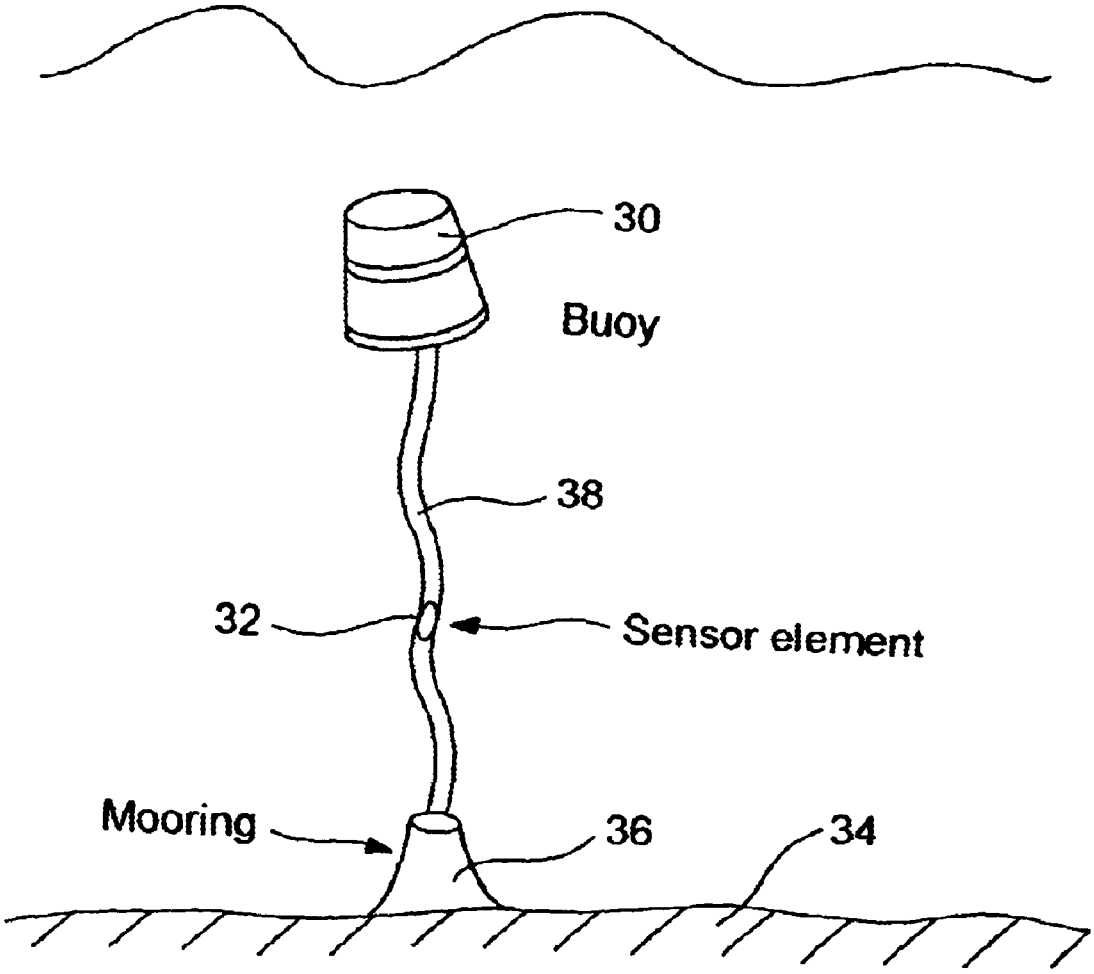
FIG. 9 shows a buoy and sensor moored to the ocean floor by an elongate body having a generally circular cross section and a wavy longitudinal axis.

FIG. 9 schematically illustrates a possible application for an elongate body having a wavy longitudinal axis. FIG. 9 shows a buoy 30 and sensor element 32 moored to the bottom 34 of a large body of water, such as an ocean. The structure which connects buoy 30 and sensor 32 to mooring 36 anchored to bottom 34 is an elongate body 38 having a wavy longitudinal axis. One end of body 38 is coupled to mooring 36, while the other end is coupled to buoy 30. Sensor element 32 is disposed along the length of body 38. Assuming that a prevailing current exists, a plane containing the wavy longitudinal axis is oriented substantially parallel to the direction of such prevailing current. This arrangement will decrease the drag forces created on the structure by the current and suppress vortex-induced vibrations which might otherwise be present.

Figure 10A:
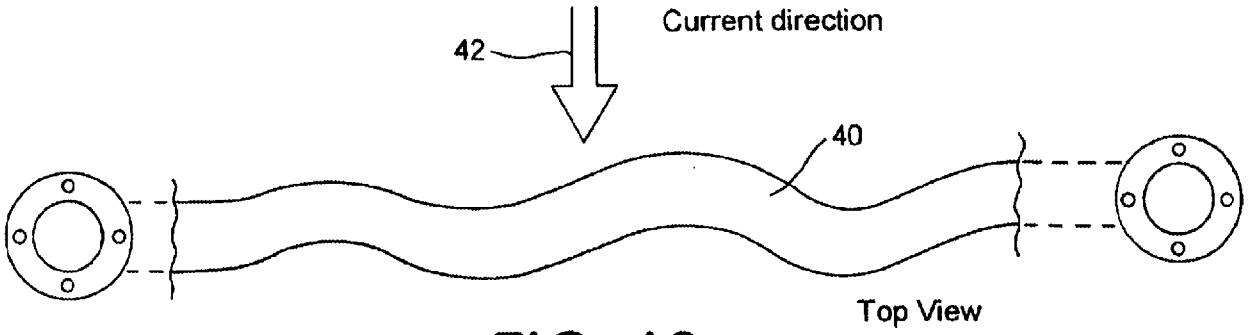
FIGS. 10*a* and 10*b* show top and side views, respectively, of an arrangement in which a pipe line having a substantially circular cross section and a wavy longitudinal axis extends through the flow stream of a river with the direction of current flow being substantially parallel to a plane containing the wavy axis of the pipe line.
Figure 10B:
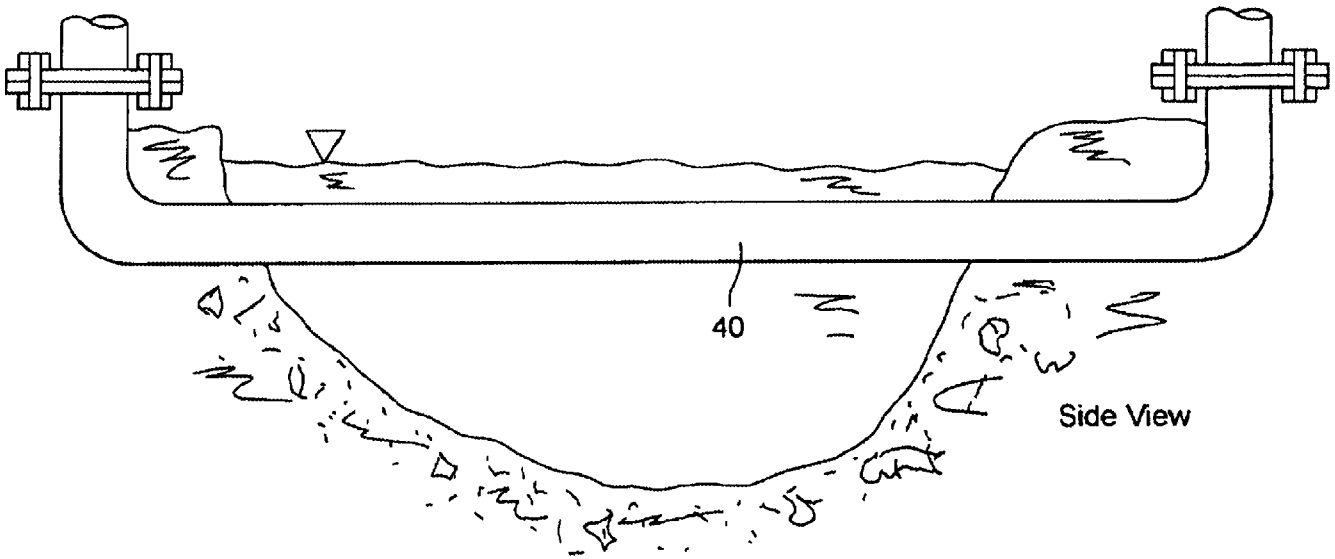

FIG. 10*a* shows a top or plan view of a pipe line 40 which has a longitudinal axis extending along a substantially sinusoidal or wavy path. As illustrated in the cross sectional side view of FIG. 10*b*, pipe line 40 extends beneath the surface of a river (or other body of water) having a prevailing current in the direction illustrated by arrow 42. The wavy axis lies in a plane which is oriented substantially parallel to current direction 42. As is the case with the arrangement illustrated in FIG. 2, a substantial reduction in drag and substantial suppression of vortex-induced vibrations result from such an arrangement.

Figure 11:
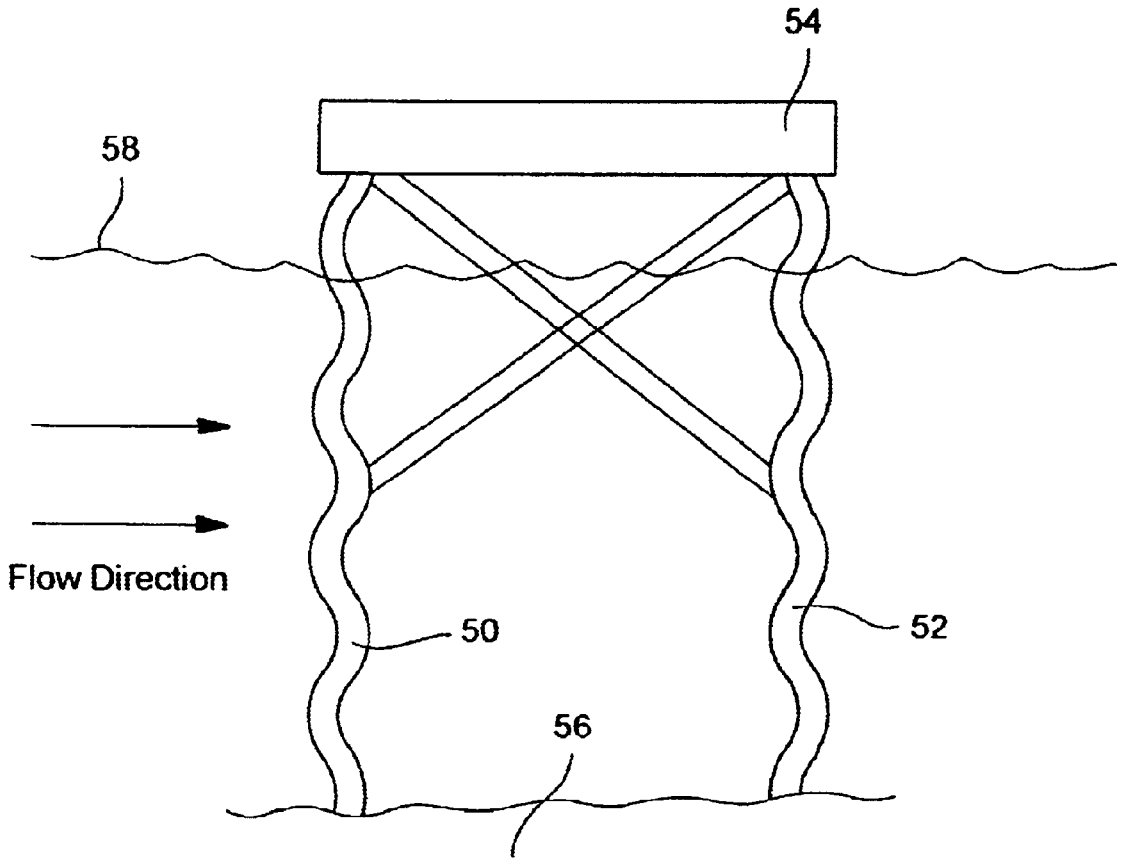
FIG. 11 shows a platform or dock supported in a body of water by substantially vertical support members formed as elongate bodies having substantially circular cross sections and wavy longitudinal axes lying in planes parallel to the direction of predominant current flow.

FIG. 11 shows another application in the form of support members 50 and 52 for a platform or dock 54 extending into a body of water. Supports 50 and 52 are elongate bodies coupled at one end to the bottom 56 of the body of water. Supports 50 and 52 are substantially circular in cross section, and have longitudinal axes extending along a wavy path. Support members 50 and 52 are oriented so that a plane containing the wavy longitudinal axis of each member is disposed in a direction which is parallel to the prevailing direction of water flow below a surface 58. The flow of water past structures 50 and 52 is modified in the manner described above so as to reduce forces on the supports and overall structure produced by drag and vortex shedding.

Figure 12B:
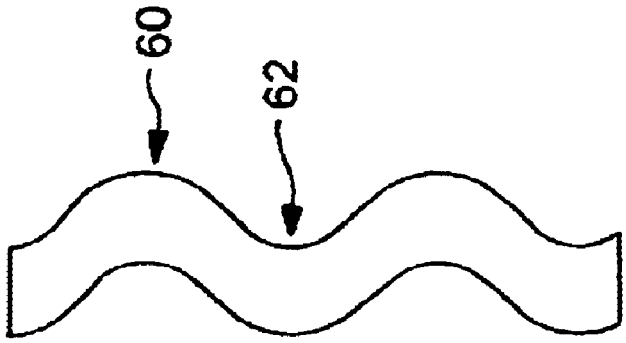
FIG. 12*b* shows a cross-section along line A—A of FIG. 12*a*.
Figure 12A:
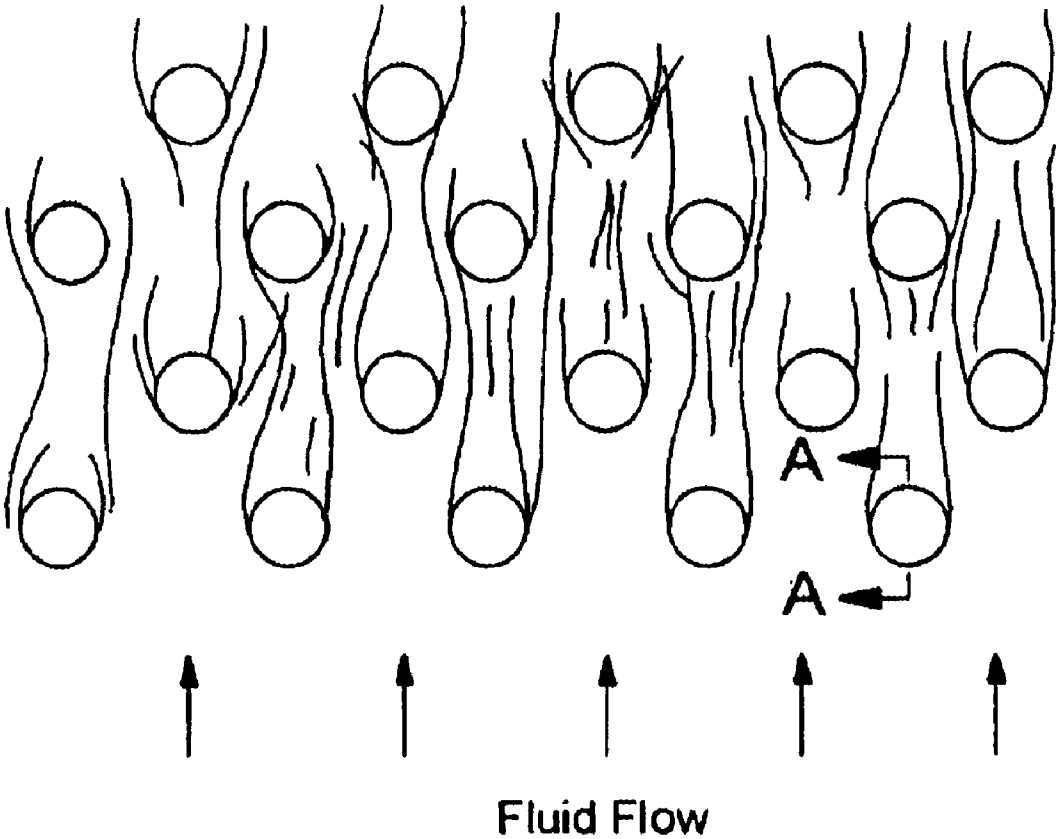
FIG. 12*a* shows a multi-row staggered tube heat exchanger having several design options for tube orientation and stagger to increase heat transfer, operate under vortex-induced vibration-free conditions, and reduce pressure drop for a given through flow.

FIGS. 12*a* and 12*b* illustrate another application in a multi-row, staggered tube heat exchanger. FIG. 12*a* is a plan view of a plurality of heat exchanger tubes viewed from a direction which is perpendicular to the fluid flow. FIG. 12*b* is a cross-section taken longitudinally along line A—A of one tube. Several design options and arrangements involving tube orientation and stagger are available to increase heat transfer, suppress vortex-induced vibrations, and reduce or further control pressure drop through the heat exchanger. The relative positions of peaks (60) and troughs (62) of adjacent tubes may be varied to achieve optimal performance.

Other applications for the structures and methods of the present invention include structural supports for microwave towers, off shore platforms and piers. Other applications in which an elongate body (particularly, one having a circular cross section) is disposed in an area of fluid flow and is affected by forces induced by drag and vortex shedding will be apparent of those of ordinary skill in the mechanical and fluid flow arts. Such applications are considered to be within the scope of the present invention.

What is claimed is:

1. A structural element comprising:

an elongate body having a longitudinal axis extending along a wavy path, said body being coupled to a support on at least one end, and at least a portion of said body extending through an area of fluid flow such that a plane containing the longitudinal axis and the wavy path lies substantially parallel to a predominant direction of said fluid flow, wherein the predominant direction of fluid flow is transverse to the longitudinal axis of the elongate body and is adapted for reducing drag on and suppressing vortex-induced vibrations of said fluid flow in the elongate body.

2. The structural element according to claim 1, wherein the longitudinal axis extends along a substantially sinusoidal path.

3. The structural element according to claim 1, wherein said elongate body is coupled to a support at both ends.

4. The structural element according to claim 1, wherein said portion of said body extending through the area of fluid flow extends for multiple wave lengths through the area of fluid flow.

5. The structural element according to claim 1, wherein a wave steepness of the longitudinal axis is greater than approximately 0.05.

6. The structural member as claimed in claim 1, wherein said elongate body comprises one of a support element for an apparatus moored in a body of water; a pipe extending through an area of fluid flow; a support member for a platform or dock; an off shore riser; an underwater cable; a piling; a chimney; and a tubular element in a heat exchanger, boiler, turbine or compressor.

7. A method of reducing drag on and suppressing vortex-induced vibrations in an elongate body disposed in an area of directional fluid flow, comprising the steps of:

a. coupling at least one end of the elongate body to a support;

b. forming a longitudinal axis of the elongate body along a wavy path; and c. orienting the elongate body such that the longitudinal axis and the wavy path lie in a plane substantially parallel to the direction of the fluid flow, wherein the predominant direction of fluid flow is transverse to the longitudinal axis of the elongate body and is adapted for reducing drag on and suppressing vortex-induced vibration of said fluid flow in the elongate body.

8. A method according to claim 7, wherein said elongate body has a substantially circular cross section.

9. A method according to claim 7, wherein said longitudinal axis extends along a substantially sinusoidal path.

10. A method according to claim 7, comprising the additional step of connecting a second end of the body to a structure or device to be supported by the elongated body.

11. A method according to claim 7, comprising the additional step of coupling both ends of the body to respective supports.

12. A method according to claim 7, wherein the elongate body comprises one of a support element for an apparatus moored in a body of water; a pipe extending through an area of fluid flow; a support member for a platform or dock; an off shore riser; an underwater cable; a chimney; and a tubular element in a heat exchanger, boiler, turbine or compressor.

13. The structural element of claim 1 wherein the predominant direction of fluid flow is substantially perpendicular to the longitudinal axis of the elongate body.

14. The method of reducing drag on and suppressing vortex-induced vibrations as recited in claim 7 wherein the predominant direction of fluid flow is substantially perpendicular to the longitudinal axis of the elongate body.

* * * * *